United States Patent [19]

Yamamoto et al.

[11] 4,437,136

[45] Mar. 13, 1984

[54] ELECTROMAGNET

[75] Inventors: Etsuji Yamamoto, Hachioji; Kensuke Sekihara, Shinjuku; Hideki Kohno, Suginami, all of Japan

[73] Assignee: Hitachi, Ltd., Tokyo, Japan

[21] Appl. No.: 389,075

[22] Filed: Jun. 16, 1982

[30] Foreign Application Priority Data

Jun. 24, 1981 [JP] Japan ..... 56-96699

[51] Int. Cl.[3] ..... H01H 47/00

[52] U.S. Cl. ..... 361/146; 307/104

[58] Field of Search ..... 361/143, 146, 1, 25, 361/103; 307/104; 219/501, 505

[56] References Cited

U.S. PATENT DOCUMENTS 2,787,737 4/1957 MacLeish ..... 361/146

3,224,375 12/1965 Hoff ..... 361/143 X 3,582,712 6/1971 Blair ..... 361/25

4,061,960 12/1977 Lloyd ..... 361/146 X 4,195,324 3/1980 Waltz ..... 361/25

*Primary Examiner*—Patrick R. Salce

*Assistant Examiner*—D. Jennings

*Attorney, Agent, or Firm*—Antonelli, Terry & Wands

[57] ABSTRACT

An electromagnet having a current detecting device for detecting the current flowing through an electromagnet exciting coil, the output of which is utilized to control the power supplied to the coil to stabilize the current flowing through the coil; the electromagnet further including a separate power supply to supply current to the current detecting device which supplies current to the current detecting device when the electromagnet is not on working.

11 Claims, 4 Drawing Figures

ELECTROMAGNET

BACKGROUND OF THE INVENTION

The present invention relates to an electromagnet for generating a static magnetic field to be used in a nuclear magnetic resonance apparatus.

The nuclear magnetic resonance apparatus has conventionally been widely used for analyzing the chemical structure of substances, particularly in recent days for imaging living bodies. As is well known, the static magnetic field used in this device must have very stable characteristics, and therefore the exciting current of the magnet needs to be made highly stable. In order to obtain such high stability of the exciting current, various kinds of feedback circuits associated with a current sensor have been provided. In this case, the current detecting sensor portion itself is so sensitive to the surrounding temperature that it needs to be placed in a temperature stabilized case. When the apparatus is not operated, the exciting current supply to the electromagnet is stopped to save power, and the heat generated in a current detecting circuit is very different between when the apparatus is on working and not on working. Such a temperature difference is compensated by the temperature stabilized case. This temperature compensation system has a problem, however, in that some medium put in the temperature stabilized case creates a time delay in the temperature compensation or a true temperature distribution cannot be obtained when the apparatus starts operating. Accordingly, it generally takes one hour or more after it is started for the apparatus to reach its stable operating state.

SUMMARY OF THE INVENTION

The present invention has been created in view of the above-mentioned defects, and therefore the object of the present invention is to provide an electromagnet with superior starting characteristics when operation of the apparatus is started, and further has low power consumption.

This object can be achieved by an electromagnet having a current detecting means which detects the exciting current and provides a signal to stabilize the exciting current, characterized in further including a heating means for heating the current detecting means while the apparatus to which the electromagnet is applied is not on working.

DESCRIPTION OF THE PREFERRED EMBODIMENTS

The electromagnet of the present invention is used for generating a static magnetic field in a nuclear magnetic resonance apparatus which analyzes the chemical structure of a substance or performs imaging of a living body using nuclear magnetic resonance.

Figure 1:
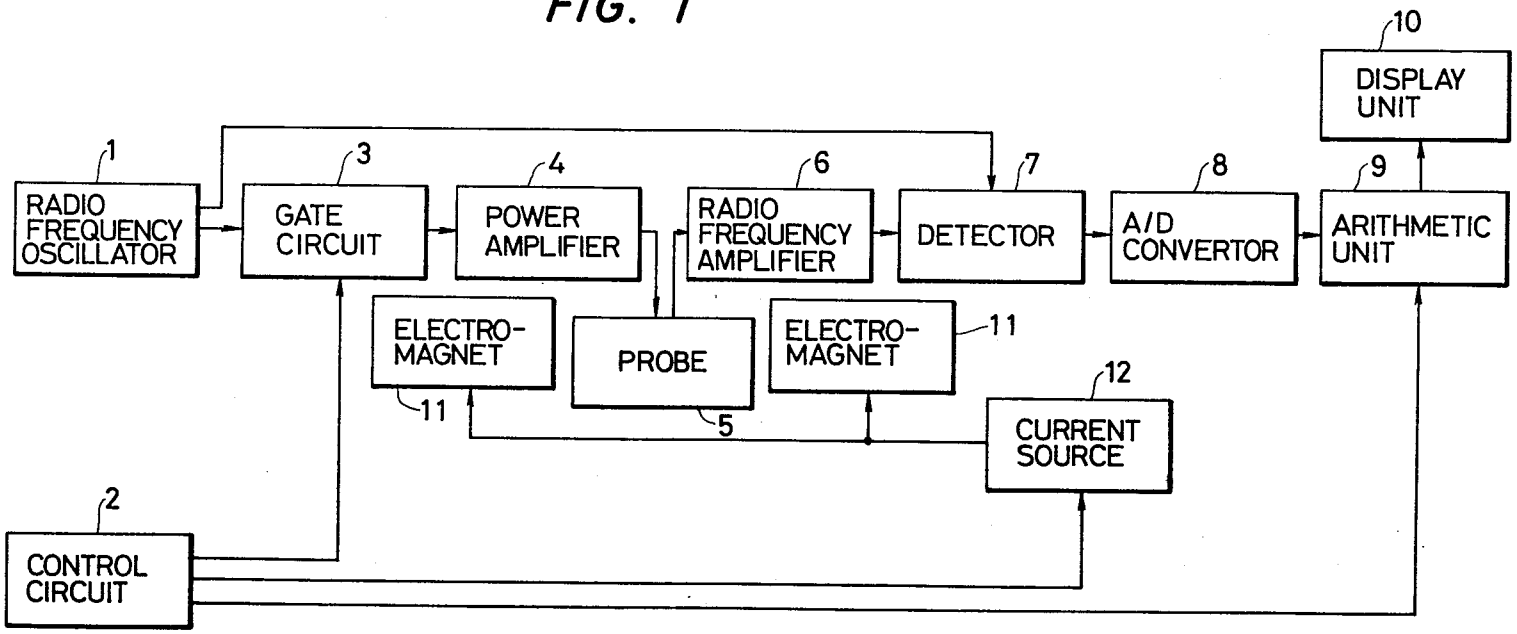
FIG. 1 is a schematic diagram for explaining the structure of a nuclear magnetic resonance apparatus using the electromagnet of the present invention.

An example of nuclear magnetic resonance apparatus is illustrated in FIG. 1. An output from a highly stabilized radio frequency oscillator 1 passes through a gate circuit 3 which opens and closes in response to a command from a control circuit 2 to reach a power amplifier 4, where it is amplified. The amplified output from the amplifier 4 drives a probe 5 which comprises a resonance circuit consisting of a coil and a capacitor for generating a radio frequency magnetic field within the coil. This probe 5 also functions to detect a nuclear signal generated from a test body (not shown). A radio frequency amplifier 6 amplifies a signal from the probe 5, and a detector 7 detects the thus amplified signal to detect the envelope of the radio frequency signal. In this detection, the detector 7 carries out a synchronous detection by using the output from the oscillator 1 as a reference signal. The output from the detector 7 is converted by an A/D converter 8 into a digital value, and subsequently subjected to Fourier analysis, filtering and the like in an arithmetic unit 9, and finally displayed on a display unit 10. The probe 5 is disposed in the static magnetic field generated by the electromagnet 11 in order to create the nuclear magnetic resonance by means of this static magnetic field and the radio frequency magnetic field generated by the probe 5. The electromagnet 11 is driven by a constant current source 12.

Figure 2:
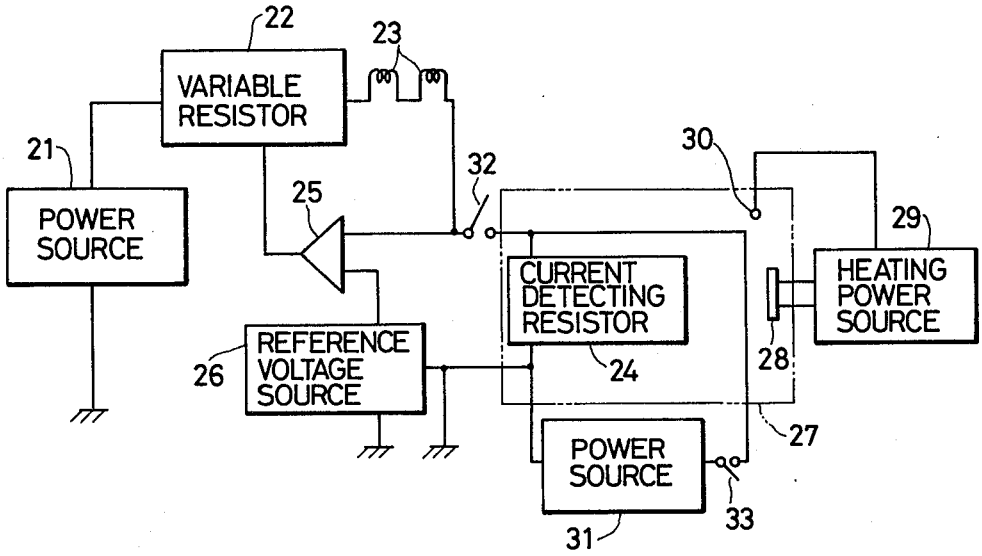
FIGS. 2 to 4 are schematic diagrams showing the structure of the electromagnet according to respective embodiments of the present invention.

FIG. 2 is a block diagram for showing the structure of an important part of the electromagnet of the present invention, namely the structure of a constant current circuit by the resistance drop method. A primary stabilized power source 21 supplies current to a variable resistor 22 comprising a transistor, FET or the like, and the output from the variable resistor 22 passes through an electromagnet exciting coil 23 and a current detecting resistor 24. In this instance, a static magnetic field is generated by the coil 23. The probe 5 is arranged in the thus generated static magnetic field, as mentioned above, though not shown in FIG. 2.

A voltage Vo generated across the current detecting resistance 24 is impressed on a differential amplifier 25. The differential amplifier 25 provides an output proportional to the difference between a voltage Vr of a reference voltage source 26 and the impressed voltage Vo so as to control the variable resistor 22 thereby. This circuit system becomes stable at the point in time when $Vr \approx Vo$.

To stabilize the static magnetic field generated by the electromagnet it is necessary to stabilize the current Io flowing through the coil 23, because the static magnetic field depends on the current Io. The degree of the stability of the current Io is determined by the stability of the current control system consisting of the reference resistance 24, reference power source 26, variable resistor and differential amplifier 25. As the reference power source 26, a mercury cell having a small temperature coefficient or a zener diode contained in a temperature stabilized case can be mentioned. On the other hand, high performance can be obtained in the current control system by a differential amplifier with low drift and high gain. Accordingly, the stability of the current Io is practically determined by the reference resistance 24, and therefore, it is important to improve the stability of the reference resistance 24. For this purpose, the reference resistance 24 is usually retained in the temperature stabilized case 27. This case 27 is provided with a heater 28, a heating power source 29, and a temperature sensor 30. The heating power source 29 is responsive to the output from the temperature sensor 30 and controls the rate of power supply to the heater 28 so that the temperature in the temperature stabilized case is maintained substantially constant.

With the electromagnet having the above-described construction, when it is on working, the temperature of the case 27 is set at a point higher than the room temperature in view of the temperature rise due to the heat generated in the reference resistance 24. For example, a current of more than 200 A is required for the electromagnet used for imaging a living body. In this case, to detect a fluctuation of $10^{-6}$ in the current Io, assuming that the input conversion noise of the differential amplifier 25 is 2 $\mu$V, the minimum value required for the quantity R of the reference resistance 24 is given by $$R \times 200 \times 10^{-6} = 2 \times 10^{-6}$$

which yields R=0.01 Ω, and the power consumed by the reference resistance 24 is 400 W. The reference resistance 24 itself therefore becomes quite hot and radiates heat inside the room or to a cooling medium, creating a large temperature gradient in the surrounding medium.

Accordingly, in order to keep the reference resistance 24 in the same thermal state when the electromagnet is not operating as when it is operating, the temperature stabilized case must be able to control the power up to the maximum 400 w. In addition, a great temperature gradient must be produced in the medium surrounding the reference resistance 24. This, however, is too difficult to realize.

To counter this inconvenience, according to the present device, when the electromagnet is on working, a switch 32 interposed between the electromagnet exciting coil 23 and the reference resistance 24 is ON, whereas another switch 33 interposed between the reference resistance 24 and another power source 31 for supplying power to the resistance 24 is OFF, thereby supplying current Io from the power source 21 to the reference resistance 24. On the other hand, when the electromagnet is not on working, switch 32 is OFF and switch 33 is ON, thereby supplying a current Io to the reference resistance from the separate power source 31. Therefore, the thermal state of the reference resistance 24 and its surroundings when the electromagnet is not on working is substantially the same as when it is on working. Further, the total power consumption of the apparatus is as low as 400 W.

This means that the power consumed can be decreased by to less than two orders of magnitude less than when the apparatus is kept wholly in the operating state. Variations in the room temperature can be compensated by the temperature stabilized case, and the dynamic range is the same as on working. Thus the same thermal state can be maintained with a very simple structure.

The power source 31 is not restricted to a direct current source and may be an alternating power supply as long as it provides the same amount of power consumption. In this case, it is sufficient to adjust the voltage with a transformer without providing any circuit to rectify and smooth a large current. Thus, the entire structure of the apparatus can be greatly simplified.

Figure 3:
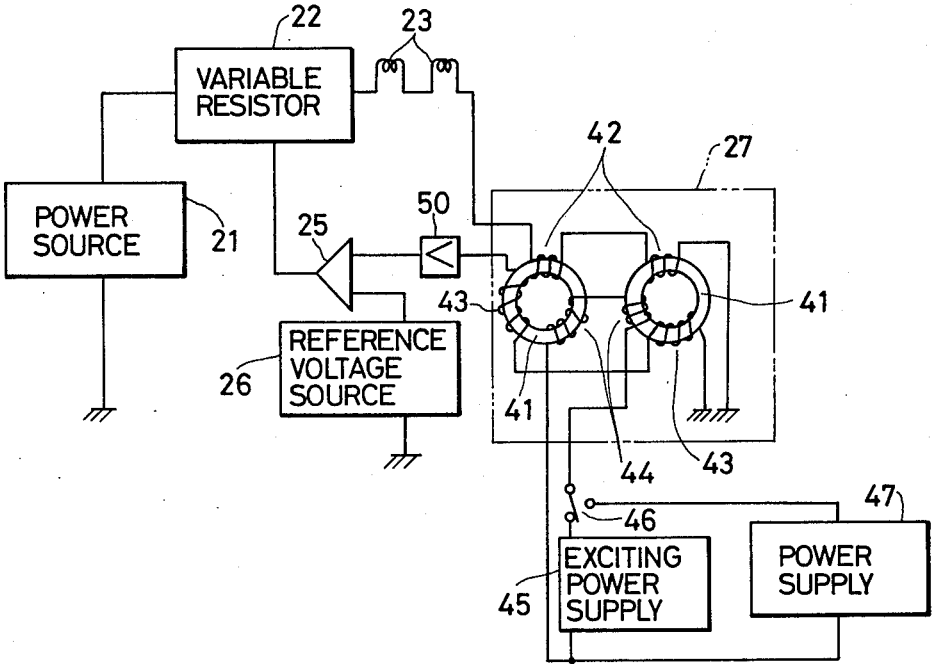

FIG. 3 shows a second embodiment of the present invention, in which a second harmonic type magnetic modulator is used as the current detecting means. The heater 28, heating power source 29 and temperature sensor 30 of the temperature stabilized case have the same structure and operation as in the first embodiment, and therefore, are omitted from this illustration and description to avoid repetition. In this particular embodiment, the current sensor of the magnetic modulator comprises a pair of cores 41 having the same characteristics, a current detecting winding 42, a signal detecting winding 43 and an exciting winding 44, all wound around the cores 41.

In this construction, when the current flowing through the winding 42 is zero, the magnetic flux generated from winding 44 excited by an exciting alternating power supply 45 of a frequency $f_0$ is mutually cancelled by the detecting windings 43 of the two coils 41.

On the contrary, when a current flows through winding 42, the hysteresis curve of the core 41 is assymetrical and a component of $2f_0$ is generated in the detecting winding 43. This component is proportional to the current flowing through winding 42. This component is detected and amplified by the detecting circuit 50 and input to the differential amplifier 25. The use of the thus constructed magnetic modulator enables the power consumption of the winding 42 to be minimized.

In this case, the heat generated in the current detecting sensor part is due mainly to the excitation of the core 41 and is caused by hysteresis losses within the core 41. Consequently, to maintain the core at a constant temperature it is sufficient to leave the core exciting power source 45 operating when the electromagnet is not on working, or supply current to the core 41 from the direct or alternating power supply 47 by throwing switch 46. In the case of leaving the power source 45 in operation, the power consumption is several watts at most. In the case of using another power source 47, a high resistance wire is used as the exciting winding 44, to utilize the Joule heat of the winding.

Figure 4:
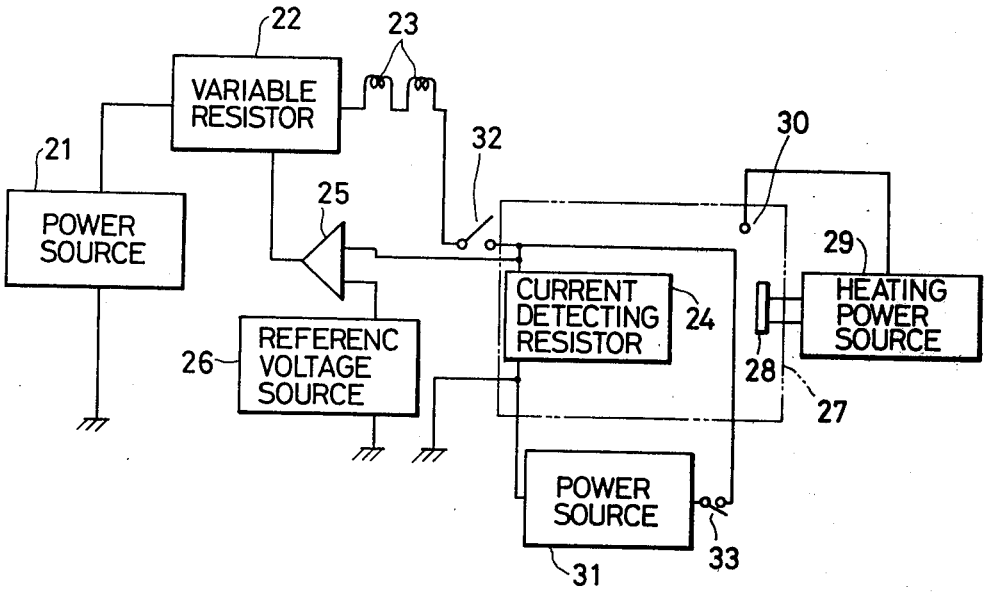

FIG. 4 shows a third embodiment of the present invention which is different from the first embodiment shown in FIG. 2 in that the detection of the voltage of the reference resistance 24 is not through the switch 32. This construction is advantageous in that it eliminates the possibility of detecting a voltage different from the true voltage generated across the reference resistance under the influence of a thermoelectric effects or the contact resistance between the contacts of the switch 32.

As described above, the present invention provides the electromagnet having superior starting characteristics from a small power consumption.

We claim:

1. An electromagnet comprising an electromagnet exciting coil, a current detecting means for detecting the current flowing through said coil, a control means for controlling the current supplied to said coil in accordance with the output from said current detecting means, and a heating means for heating said current detecting means, said electromagnet characterized in that said current detecting means is heated by said heating means when said electromagnet is not on working.

2. An electromagnet as set forth in claim 1, wherein said current detecting means comprises a resistor and said heating means comprises a power supply for supplying current to said resistor.

3. An electromagnet as set forth in claim 2, wherein said resistor is housed in a temperature stabilized case.

4. An electromagnet as set forth in claim 2, wherein said power supply is a direct current power supply.

5. An electromagnet as set forth in claim 2, wherein said power supply is an alternating current supply.

6. An electromagnet as set forth in claim 1, wherein said current detecting means comprises a magnetic modulator which comprises a core, a current detecting winding, signal detecting windings and an exciting winding all wound around said core and a power supply to supply current to said exciting winding, said magnetic modulator also serving as said heating means.

7. An electromagnet as set forth in claim 6, wherein said exciting winding is constantly supplied with current from said power supply.

8. An electromagnet as set forth in claim 6, wherein said power supply comprises a first and a second power supply, and said two power supplies are so adapted that the current supplied to said exciting winding is from said first power supply when said electromagnet is on working and from said second power supply when said electromagnet is not on working.

9. An electromagnet as set forth in claim 6, wherein said core is housed within a temperature stabilized case.

10. An electromagnet as set forth in claim 7, wherein said power supply is an alternating current power supply.

11. An electromagnet as set forth in claim 8, wherein said first power supply is an alternating current power supply and said second power supply is a direct or alternating current power supply.

* * * * *